United States Patent [19]

Kembar

[11] 4,095,801

[45] Jun. 20, 1978

[54] CHESSMEN CONTAINED BY CHESS BOARD OR A CUBE CONTAINER

[76] Inventor: Ross John Kembar, 4678 Eastridge Road, North Vancouver, British Columbia, Canada

[21] Appl. No.: 701,516

[22] Filed: Jul. 30, 1976

[51] Int. Cl.[2] ..... A63F 3/02

[52] U.S. Cl. ..... 273/260; 273/290; 273/285; 273/287

[58] Field of Search .... 273/131 AC, 131 K, 131 KC, 273/131 KN, 131 KP, 131 B, 137 R, 137 AE, 136 D, 136 K; D34/5 CH; 46/24, 16

[56] References Cited

U.S. PATENT DOCUMENTS

| | | | |
|---|---|---|---|
| D. 207,323 | 4/1967 | Hanna | D34/5 CH |
| 3,517,935 | 6/1970 | Graham | 273/137 R |
| 3,677,550 | 7/1972 | Mathers | 273/137 R |
| 3,801,105 | 4/1974 | Soubrier | 273/137 AB |

FOREIGN PATENT DOCUMENTS

| | | | |
|---|---|---|---|
| 201,550 | 12/1923 | United Kingdom | 273/136 D |

*Primary Examiner*—Richard C. Pinkham
*Assistant Examiner*—Arthur S. Rose

[57] ABSTRACT

A set of chessmen comprising 32 pieces nesting vertically into a rectangular parallelepiped and contained by the folded chess board. Another embodiment of the set, (should a person have their own board) is that the nesting will layer into a perfect cube container.

The cross-section of each piece is constant throughout its length. The cross-section of each piece is indicative of the direction that each piece moves in the game of Chess.

The mass of each piece is indicative of the importance of that piece in the game of Chess.

3 Claims, 31 Drawing Figures

CHESSMEN CONTAINED BY CHESS BOARD OR A CUBE CONTAINER

BACKGROUND OF THE INVENTION

The set was designed as a simplified way in which children can learn to play chess. At first the pieces are blocks and the interest for the young is to fit the blocks together into the chess board or the cube container. Later a person learns that the horizontal section of each piece is indicative of its move and the mass of each piece is suggestive of its relative power.

DRAWINGS

FIGS. 19 - 24 inclusive are horizontal sectional views of the King, Queen, Castle, Bishop, Knight and Pawn respectively. The size of these sections are all taken from the King base of 1 unit × 1 unit.

FIGS. 25 - 30 inclusive are perspective views of the King, Queen, Castle, Bishop, Knight and Pawn respectively.

Figure 31:
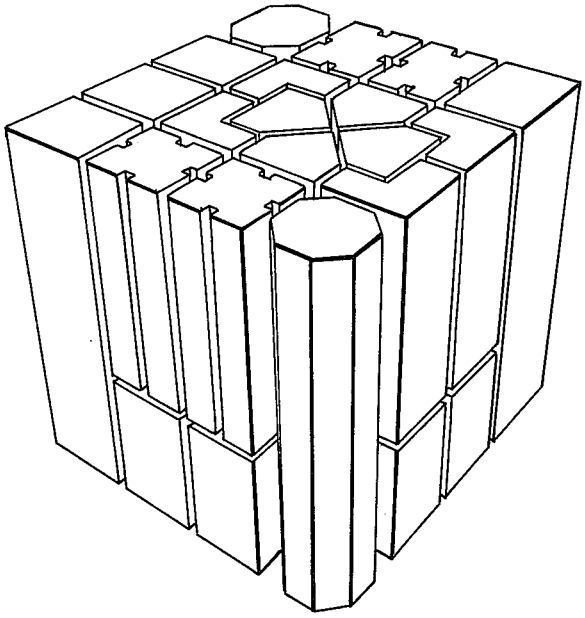

FIG. 31 is a perspective view showing the nesting set formed into a perfect cube. The box for the set can be any cube container.

The King (FIG. 1) has a square section each side of which is $1\frac{1}{2}$ units long. From this section the Queen (FIG. 2), an octagon is taken.

Figure 3:
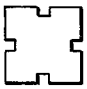

The Pawn (FIG. 6) has a square section of area 1 from which is taken the Knight (FIG. 5), the Bishop (FIG. 4), and the Castle (FIG. 3). The pawn's height is 1.5 times its base width. The Knight, Bishop and Castles height are three times the base width of one.

The King and Queens height is 3.5 times the Pawns base width of one unit.

DETAILED DESCRIPTION

Figure 16:
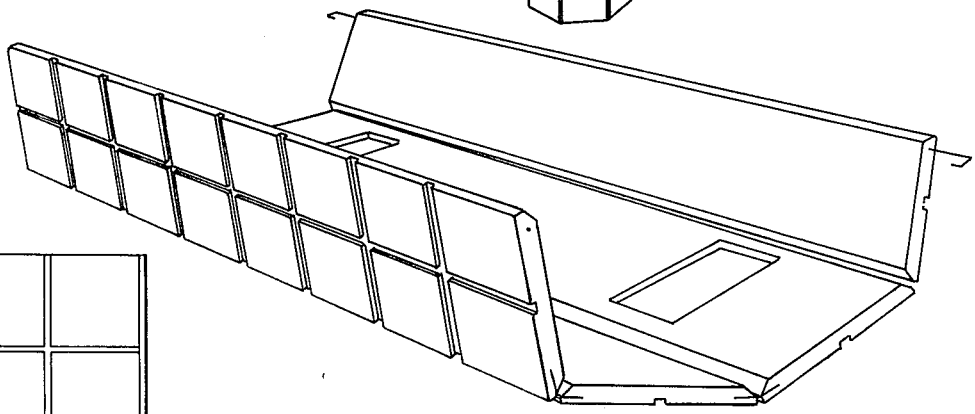
FIG. 16 is a perspective view of the Chess Board partially folded into its container form.

NOTE: All of the sets described herein have the following common qualities:

a. Every piece has a constant section throughout its length.
b. There is only one way in which the Knights and Bishops can nest together, see (FIG. 13)
c. All pieces nest together in a vertical position.
d. In a correctly stacked set there are no major voids.
e. In the Chess Board Container Set the King and Queen must be stacked in the rebates of the board bottom as shown in FIG. 16.

FIG. 1 and FIG. 7

Figure 1:
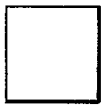
FIGS. 1,2,3,4,5,6, are horizontal sectional views (plan views) of the King, Queen, Castle, Bishop, Knight and Pawn pieces respectively. Each sectional view is constant throughout its length.
Figure 7:
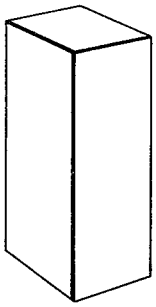
FIGS. 7,8,9,10,11 and 12 represent perspective views of the King, Queen, Castle, Bishop, Knight and Pawn pieces respectively.

FIG. 1 illustrates the plan and sectional view of the King. It has a square base each side of which is $1\frac{1}{2}$ units long. Because it is the most important piece in the game of Chess it has the greatest volume. FIG. 7 is a perspective view of the King. Its length is $3\frac{1}{2}$ units relative to the pawn with the base unit of 1.

FIG. 2 and FIG. 8

Figure 2:
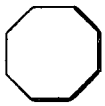
Figure 8:
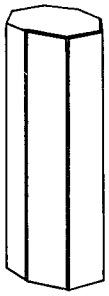

FIG. 2 illustrates the plan and sectional view of the Queen. It has an octagonal base indicating that it moves in eight directions on the chess board. The distance between any two parallel sides is $1\frac{1}{2}$ units. FIG. 8 is a perspective view of the Queen. Its length is $3\frac{1}{2}$ units.

FIG. 3 and FIG. 9

Figure 9:
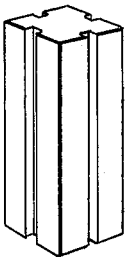

FIG. 3 illustrates the plan and sectional view of the Castle. It has a square base of one unit. A $\frac{1}{8}$ unit area has been removed from each side of the piece to make the piece appear castle-like. The parallel sides indicate that it moves parallel to the sides of the chess board. FIG. 9 is a perspective view of the Castle. Its length is 3 units.

FIG. 4 and FIG. 10

Figure 4:
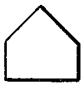
Figure 10:
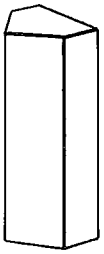

FIG. 4 illustrates the plan and sectional view of the Bishop and shows a 90° dihedral angle cut out of one of its sides. The area of its base is 0.75 of the Pawns base area of 1 unit. The longest side of the Bishops base is 1 unit and its parallel sides are each $\frac{1}{2}$ unit long. The dihedral angle indicates that the Bishop moves diagonally across the chess board. FIG. 10 is a perspective view of the Castle. Its length is 3 units.

FIG. 5 and FIG. 11

Figure 5:
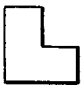
Figure 11:
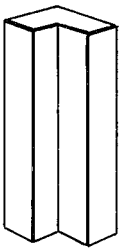

FIG. 5 illustrates the plan and sectional view of the Knight. It has an 'L' shaped base and is 0.75 of the area of the base of the Pawn. The length of the two long perpendicular sides of its base are both equal to 1 unit. The section indicates that the Knight moves in an 'L' direction in the game of Chess. Fig. 11 is a perspective view of the Knight. Its length is 3 units. The other four short sides have a width of $\frac{1}{2}$ unit each.

FIG. 6 and FIG. 12

Figure 6:
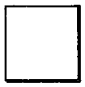
Figure 12:
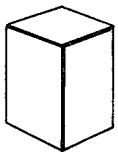

FIG. 6 illustrates the plan and sectional view of the Pawn. It has a square section of unit 1 × unit 1. FIG. 12 is a perspective view of the pawn. Its length is 1.5 units.

FIG. 13

Figure 13:
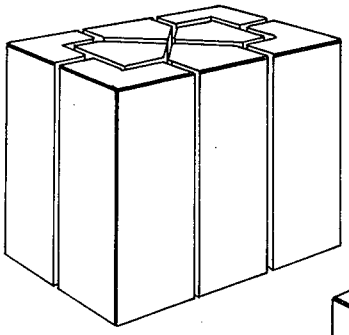
FIG. 13 represents a perspective view of the only way the Knights and Bishops can nest together.

FIG. 13 is a perspective showing the only way in which the four Knights and four Bishops nest together. This configuration is carried through with any of the alternate patterns of nesting. ie. See FIG. 15 and FIG. 31.

FIG. 14

Figure 14:
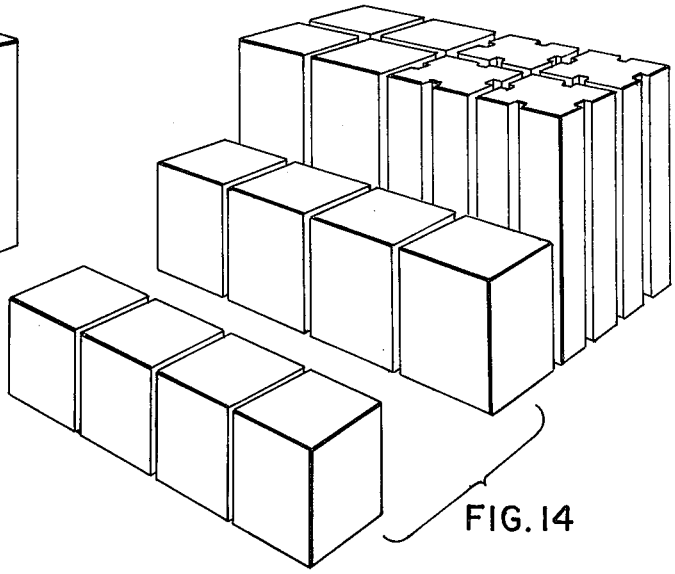
FIG. 14 represents a perspective view of one way the Pawns and Castles can nest together.

FIG. 14 is a perspective view showing one way in which 16 pawns and four Castles nest together. It can be seen that two pawns stacked equals the height of a Castle.

FIG. 15

Figure 15:
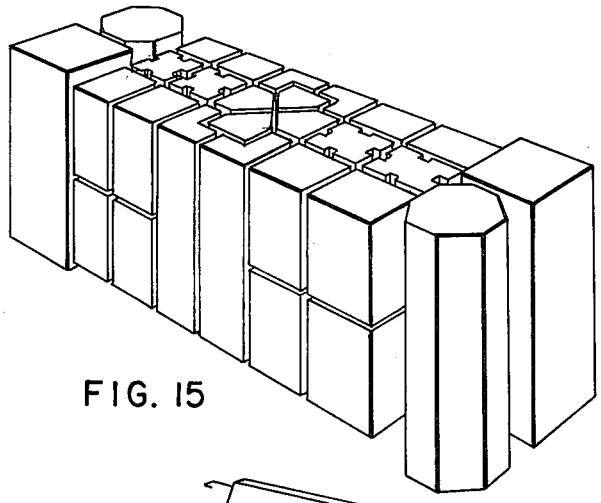
FIG. 15 is a view of the Chess set nesting together to enable it to be enclosed by the Chess Board.

FIG. 15 is a perspective view showing the complete set of Chessmen so nesting as to be placed into the chess board container.

FIG. 16

FIG. 16 is a perspective of the underside of the chess board and illustrates the way in which the board folds up and around the nesting set to become the container for it. The board is made up of four equal sides. Each long edge is splayed and hinged together. A simple pin locks the box in the closed position, FIG. 17. The King and Queen sit into the rebated top and bottom sections of the board so as to hold the internal pieces of the set in place. The area of each square of the chess board is four times the Pawns base area. Each side of the face of the chess board has 16 squares.

FIG. 17

Figure 17:
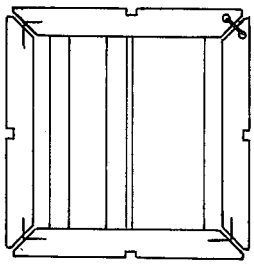
FIG. 17 is an end view of the Chess Board closed, showing the King and Queen acting as the closure for the end.

FIG. 17 is an end elevation of the chess board container in its closed position. 17A shows the location of the locking pin and 17B shows the location of the continuous hinge. Neither hinges or locking mechanism form part of my claim and are inserted in the drawings to illustrate how the chess board folds and is closed. A portion of the King and Queen chess playing pieces can be seen through the open end of the folded board.

FIG. 18

Figure 18:
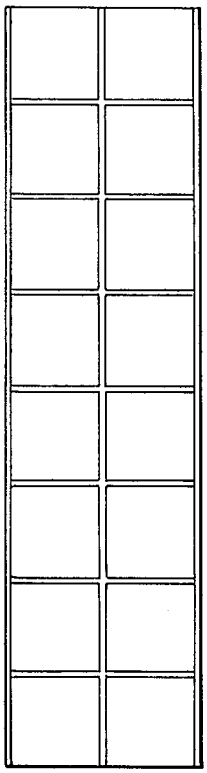
FIG. 18 is a side view of the Chess Board closed.

FIG. 18 is a side view of the chess board container closed. In the closed position the container can either sit on one of its long sides or stand in an upright position.

FIG. 19 to FIG. 31 (inclusive)

FIG. 19 to FIG. 31 inclusive illustrate another configuration of nesting a similar set of chessmen to the one illustrated in FIG. 1 to FIG. 12 inclusive. The configuration illustrated here nests together to form a perfect cube without voids.

Figure 19:
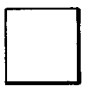
Figure 25:
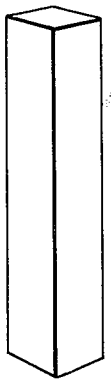

FIG. 19 and FIG. 25

FIG. 19 illustrates the plan and horizontal sectional view of the King. The length of any side of its square base is one unit. FIG. 25 is a perspective view of the King. The height of the King is four units.

Figure 20:
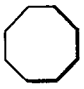
Figure 26:
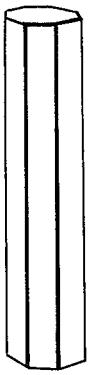

FIG. 20 and FIG. 26

FIG. 20 illustrates the plan and horizontal sectional view of the Queen. It has an octagonal base indicating that it moves in eight directions. The distance between any two parallel sides is one unit. FIG. 26 is a perspective view of the Queen. Its height is four units.

Figure 21:
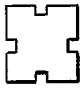
Figure 27:
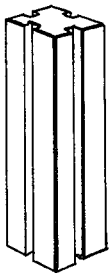

FIG. 21 and FIG. 27

FIG. 21 illustrates the plan and horizontal sectional view of the Castle. It has a square base of one unit. A $\frac{1}{8}$ unit area has been removed from each side of the piece to make the piece appear castle-like. The parallel sides indicate that the piece moves parallel to the sides of the chess board. FIG. 27 is a perspective view of the Castle. Its height is $2\frac{2}{3}$ units. When stacked into the cube container the height of one castle and one pawn equals four units.

Figure 22:
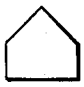
Figure 28:
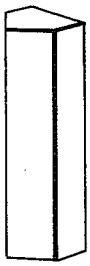

FIG. 22 and FIG. 28

FIG. 22 illustrates the plan and horizontal sectional view of the Bishop and shows a 90° dihedral angle cut out of one of its sides. The area of its base is 0.75 of the base of the King. The longest side of the Bishops base is one unit and its parallel sides are each $\frac{1}{2}$ unit long. The dihedral angle indicates that the Bishop moves diagonally across the chess board. FIG. 28 is a perspective view of the Bishop. Its height is $2\frac{2}{3}$ units.

Figure 23:
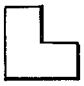
Figure 29:
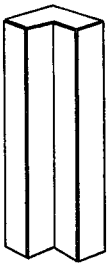

FIG. 23 and FIG. 29

FIG. 23 illustrates the plan and horizontal sectional view of the Knight. It has an 'L' shaped base and is 0.75 of the area of the base of the King. The length of the two long perpendicular sides of its base are both equal to one unit. The section indicates that the Knight moves in an 'L' direction in the game of chess. FIG. 29 is a perspective view of the Knight. Its height is $2\frac{2}{3}$ units.

Figure 24:
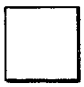
Figure 30:
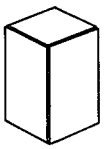

FIG. 24 and FIG. 30

FIG. 24 illustrates the plan and horizontal sectional view of the Pawn. It has a square base of one unit area, the same as the King. FIG. 30 is a perspective view of the Pawn. Its height is $1\frac{1}{3}$ units. Three pawns stacked one on top of the other equal the height of the King.

FIG. 31

FIG. 31 is a perspective view of the 32 piece Chess Set so nestled together as to form a cube. In order to accomplish the cube form, the following relative dimensions apply. If the longest distance between any two parallel sides of the plan view of any one piece is one unit, then the height of the Pawn (FIG. 30) is $1\frac{1}{3}$ units, the height of the Knight (FIG. 29), the Bishop (FIG. 28), and the Castle (FIG. 27) are $2\frac{2}{3}$ units each. The height of the King (FIG. 25) and the Queen (FIG. 26) are 4 units each. The volume of each piece is indicative of the power each piece has relative to another. The volume of the correctly stacked set of 32 pieces is 64 cubic units if the base of the King is one unit.

While I have shown and described two preferred embodiments of my invention, other modifications thereof will readily occur to those skilled in the art, and I therefore intend that my invention be limited only by the appended claims.

I claim:

1. A standard set of chessman comprising 32 pieces; 2 kings, 2 queens, 4 castles, 4 bishops, 4 knights and 16 pawns;

each of said pieces having a constant cross section throughout its length, said cross section of said 4 bishops being a polygon having three 90° interior angles and two 135° interior angles with not more than 5 sides, said cross section of said four knights being a 6 sided L shaped polygon, the shapes of said cross sections of said 2 queens, 4 castles, 4 bishops and 4 knights being indicative of the direction these pieces move in the conventional game of chess, the shape and dimensions of the said 4 castles, 4 bishops, 4 knights and 16 pawns being such that they are adapted to be vertically nested into a rectangular parallelepiped.

2. A standard set of chessman as described in claim 1, in combination with;

a chess board, means for converting said chess board into a four sided box longer than, but of the same height and width of, said rectangular parallelepiped, said 2 kings and 2 queens being of equal length, said length being longer than the shortest side of said rectangular parallelepiped, rebated means on the underside of said board, whereby when said board is converted into said four sided box said rebated means will hold said two kings and two queens in a spaced relationship such that they form the ends of said rectangular parallelepiped and thus hold said 4 castles, 4 bishops, 4 knights and 16 pawns in place.

3. A standard set of chessmen comprising 32 pieces; 2 kings, 2 queens, 4 castles, 4 bishops, 4 knights and 16 pawns;

each of said pieces having a constant horizontal cross section throughout its length, said cross section of said 4 bishops being a polygon having three 90° interior angles and two 135° interior angles with not more than 5 sides;

said cross section of said 4 knights being a 6 sided L shaped polygon, the shapes of said cross sections of said 2 queens, 4 castles, 4 bishops and 4 knights being indicative of the direction these pieces move in the conventional game of chess, the shape and dimensions of said 32 pieces being such that they are adapted to be vertically nested into a cube.

* * * * *